US009998811B1

(12) United States Patent
Avant

(10) Patent No.: US 9,998,811 B1
(45) Date of Patent: Jun. 12, 2018

(54) LARGE-CAPSULE, SIDE-ADDRESS, SWITCHABLE MULTI-PATTERN REMOVABLE ASSEMBLY FOR CONDENSER MICROPHONE

(71) Applicant: Vanguard Audio Labs, LLC, Upland, CA (US)

(72) Inventor: Ken Avant, Austin, TX (US)

(73) Assignee: Vanguard Audio Labs, LLC, Upland, CA (US)

( * ) Notice: Subject to any disclaimer, the term of this patent is extended or adjusted under 35 U.S.C. 154(b) by 0 days. days.

(21) Appl. No.: 15/806,008

(22) Filed: Nov. 7, 2017

Related U.S. Application Data

(60) Provisional application No. 62/419,297, filed on Nov. 8, 2016.

(51) Int. Cl.

| | |
|---|---|
| ***H04R 1/08*** | (2006.01) |
| ***H04R 1/04*** | (2006.01) |
| ***H04R 7/04*** | (2006.01) |
| ***H04R 19/04*** | (2006.01) |
| ***H04R 7/16*** | (2006.01) |
| ***H04R 3/00*** | (2006.01) |

(52) U.S. Cl.
CPC ..... *H04R 1/08* (2013.01); *H04R 1/04* (2013.01); *H04R 3/00* (2013.01); *H04R 7/04* (2013.01); *H04R 7/16* (2013.01); *H04R 19/04* (2013.01)

(58) Field of Classification Search
CPC ..... H04R 19/04; H04R 1/406; H04R 1/04; H04R 3/00; H04R 1/08; H04R 7/04
See application file for complete search history.

(56) References Cited

U.S. PATENT DOCUMENTS

| | | | | |
|---|---|---|---|---|
| 7,599,505 | B2 * | 10/2009 | Akino | H04R 19/04 381/113 |
| 8,059,848 | B2 * | 11/2011 | Akino | H04R 1/086 381/355 |
| 8,194,895 | B2 * | 6/2012 | Akino | H04R 1/04 381/111 |
| 8,488,830 | B2 * | 7/2013 | Yoshino | H04R 1/086 381/189 |
| 8,737,661 | B2 * | 5/2014 | Akino | H04R 1/406 381/174 |
| 8,848,950 | B2 * | 9/2014 | Shimura | H04R 19/016 381/174 |

(Continued)

*Primary Examiner* — Mohammad Islam
(74) *Attorney, Agent, or Firm* — Shifrin Patent Law; Dan Shifrin

(57) ABSTRACT

A removable condenser microphone assembly comprises a large-diaphragm condenser transducer having front and rear diaphragms; a cylindrical harness inside of which the transducer is mounted; a cylindrical ring inside of which the harness is mounted; a connector secured to the bottom of the ring configured to removably secure the microphone assembly to a body of a pencil microphone and to removably electrically couple the microphone assembly to pre-amp circuitry within the pencil microphone body; a switch secured to the ring; and a printed circuit board electrically coupled to the transducer and the switch and, in response to positions of the switch, separately control phantom power to the front and rear diaphragms of the transducer creating a plurality of selectable polar patterns of the transducer.

20 Claims, 7 Drawing Sheets

(56) References Cited

U.S. PATENT DOCUMENTS

| | | | | |
|---|---|---|---|---|
| 2006/0045302 | A1* | 3/2006 | Akino | H04R 1/06 381/355 |
| 2008/0152174 | A1* | 6/2008 | Marshall | H04R 19/04 381/172 |
| 2011/0293114 | A1* | 12/2011 | Akino | H04R 7/24 381/111 |
| 2012/0014542 | A1* | 1/2012 | Akino | H04R 1/406 381/174 |
| 2012/0250926 | A1* | 10/2012 | Akino | H04R 7/18 381/355 |
| 2012/0263334 | A1* | 10/2012 | Yoshino | H04R 1/086 381/363 |
| 2015/0003645 | A1* | 1/2015 | Akino | H04R 19/04 381/174 |
| 2017/0171670 | A1* | 6/2017 | Akino | H04R 19/04 |

* cited by examiner

LARGE-CAPSULE, SIDE-ADDRESS, SWITCHABLE MULTI-PATTERN REMOVABLE ASSEMBLY FOR CONDENSER MICROPHONE

RELATED APPLICATION DATA

The present application is related to commonly-owned and U.S. Provisional Application Ser. No. 62/419,297 entitled LARGE-CAPSULE, SIDE-ADDRESS, SWITCHABLE MULTI-PATTERN REMOVABLE ASSEMBLY FOR CONDENSER MICROPHONE, filed on Nov. 8, 2016, which application is incorporated herein by reference in its entirety.

TECHNICAL FIELD

The present invention relates generally to microphones and, in particular, to a removable assembly for a condenser microphone.

BACKGROUND ART

A condenser microphone (sometimes referred to as capacitor microphone) consists of a transducer element that uses a very thin diaphragm spaced from an electrically charged backplate that together act like a variable capacitor to change acoustic energy into electrical energy. The acoustic energy vibrates the diaphragm, changing the spacing between the diaphragm and the backplate, changing the voltage maintained across them, which creates an AC electrical signal that corresponds to the acoustic energy vibrating the diaphragm. This signal is very small and weak and needs a circuit close by (usually housed inside the microphone along with the transducer), in order to amplify the signal to make it usable.

Small diaphragm pencil condenser microphones have long been a part of the recording industry, such as the Neumann KM84, AKG 451E, and many, many other microphones. Typically, what differentiates a pencil condenser from other recording studio condenser microphones is its small size and "front address" configuration. In a front address configuration, the microphone diaphragm is positioned to accept sound from the end of the microphone (such as a standard handheld microphone), whereas in a "side address" configuration, the diaphragm is positioned to accept sound from the side of the microphone (such as typical studio microphones, where the microphone is positioned vertically and the user speaks into the side).

Pencil condensers, due to their size, also use smaller capsule diameters—typically 15-22 mm in diameter, whereas typical studio microphones use capsules in the 30-34 mm range. The size of the capsule has several pros and cons when it comes to recording—transient response, frequency response, overall size of the microphone, sensitivity, and other factors—which make a range of diaphragm sizes useful in a high-fidelity recording environment.

The capsules on pencil condenser microphones are also sometimes interchangeable. The capsule is housed in a removable assembly on the front of the microphone, and the rest of the circuit—switches, electronic components, and connectors—are contained within the body of the microphone. A small diaphragm condenser is sometimes sold with several interchangeable capsules, each with a fixed polar pickup pattern. (The polar pattern affects the microphone's ability to accept or reject sound from different positions around the microphone.) An excellent example is the Avantone CK-1 microphone, which comes with three interchangeable fixed-pattern microphone capsules. Some front-address capsules can switch among patterns without being removed from the microphone, such as the Schoeps MK-5 capsule. To change the pattern in these microphones, components of the assembly are mechanically moved to change the way in which sound reaches the capsule. And, a very few pencil condenser microphones have interchangeable large capsule side-address assemblies, each with a fixed polar pattern, such as the Soyuz SU-0117 and the Shure Beta 181.

SUMMARY OF THE INVENTION

In contrast to conventional microphones, the present invention provides a large-capsule, side-address, electronically-switchable multi-pattern removable assembly for condenser microphone.

Embodiments of the present invention provide a removable condenser microphone assembly, comprising: a large-diaphragm condenser transducer having front and rear diaphragms; a cylindrical harness inside of which the transducer is mounted; a cylindrical ring inside of which the harness is mounted; a connector secured to the bottom of the ring configured to removably secure the microphone assembly to a body of a pencil microphone and to removably electrically couple the microphone assembly to pre-amp circuitry within the pencil microphone body; a switch secured to the ring; and a printed circuit board electrically coupled to the transducer and the switch and, in response to positions of the switch, separately control phantom power to the front and rear diaphragms of the transducer creating a plurality of selectable polar patterns of the transducer.

Embodiments of the present invention also provide a removable condenser microphone assembly, comprising: a large-diaphragm condenser transducer having front and rear diaphragms mounted inside a cylindrical ring; a connector secured to the bottom of the ring configured to removably secure the microphone assembly to a microphone body and to removably electrically couple the microphone assembly to pre-amp circuitry within the microphone body; a switch secured to the ring; and a printed circuit board electrically coupled to the transducer and the switch and, in response to positions of the switch, separately control phantom power to the front and rear diaphragms of the transducer creating a selectable plurality of polar patterns of the transducer.

DETAILED DESCRIPTION OF THE PREFERRED EMBODIMENT

The described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components and so forth. In other instances, well-known structures, materials, or operations are not shown or described in detail to avoid obscuring aspects of the invention.

Figure 1:
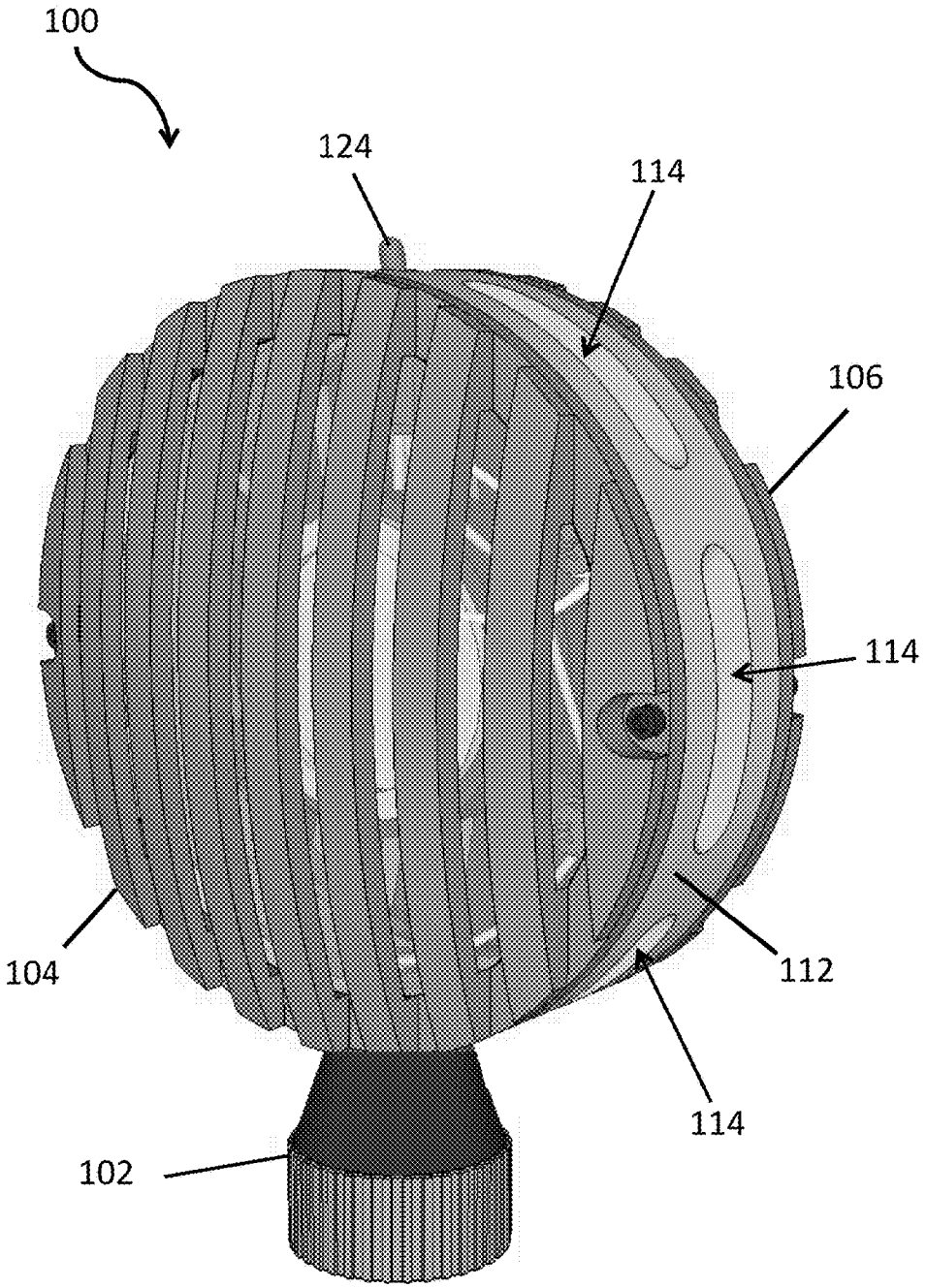
FIG. 1 is a perspective view of an embodiment of a removable condenser microphone assembly of the present invention.
Figure 2:
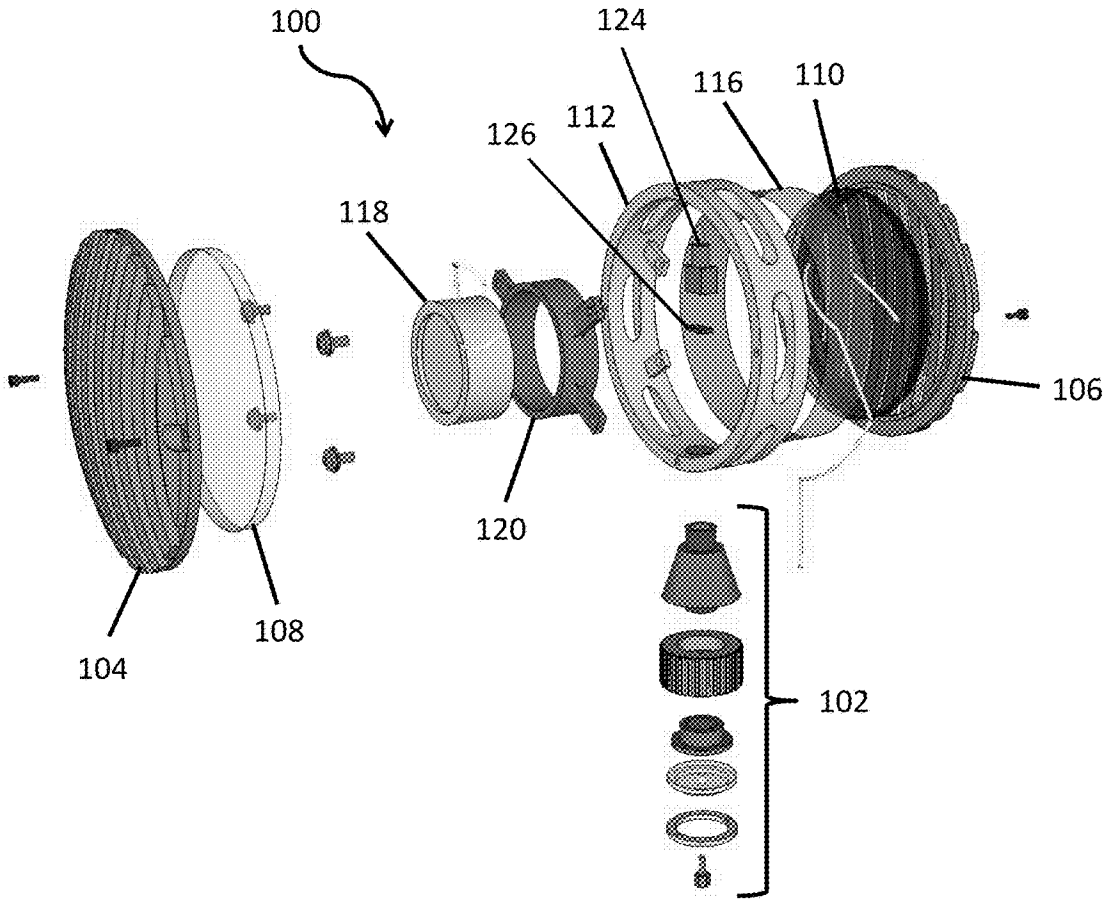
FIG. 2 is an exploded view of the assembly of FIG. 1.

FIG. 1 is a perspective view of an embodiment of a removable condenser microphone assembly 100 of the present invention and FIG. 2 is an exploded view of the assembly 100. The assembly 100 includes an electrical and mechanical connector 102 for securing the assembly 100 to the body of a pencil microphone. The front and rear of the assembly 100 are covered by front and rear grill 104, 106, respectively. Grill mesh 108, 110 is secured to the inside surfaces of the grills 104, 106. The grills 104, 106 are secured, such as with screws, to a cylindrical ring 112, which serves as a frame for the assembly 100. The connector 102 is secured to an opening in the bottom of the ring 112. The ring 112 preferably has a number of openings 114, which may be elongated to reduce or prevent standing waves across the ring 112, around its perimeter. A ring mesh 116 surrounds the outside of the ring 112.

Figure 3:
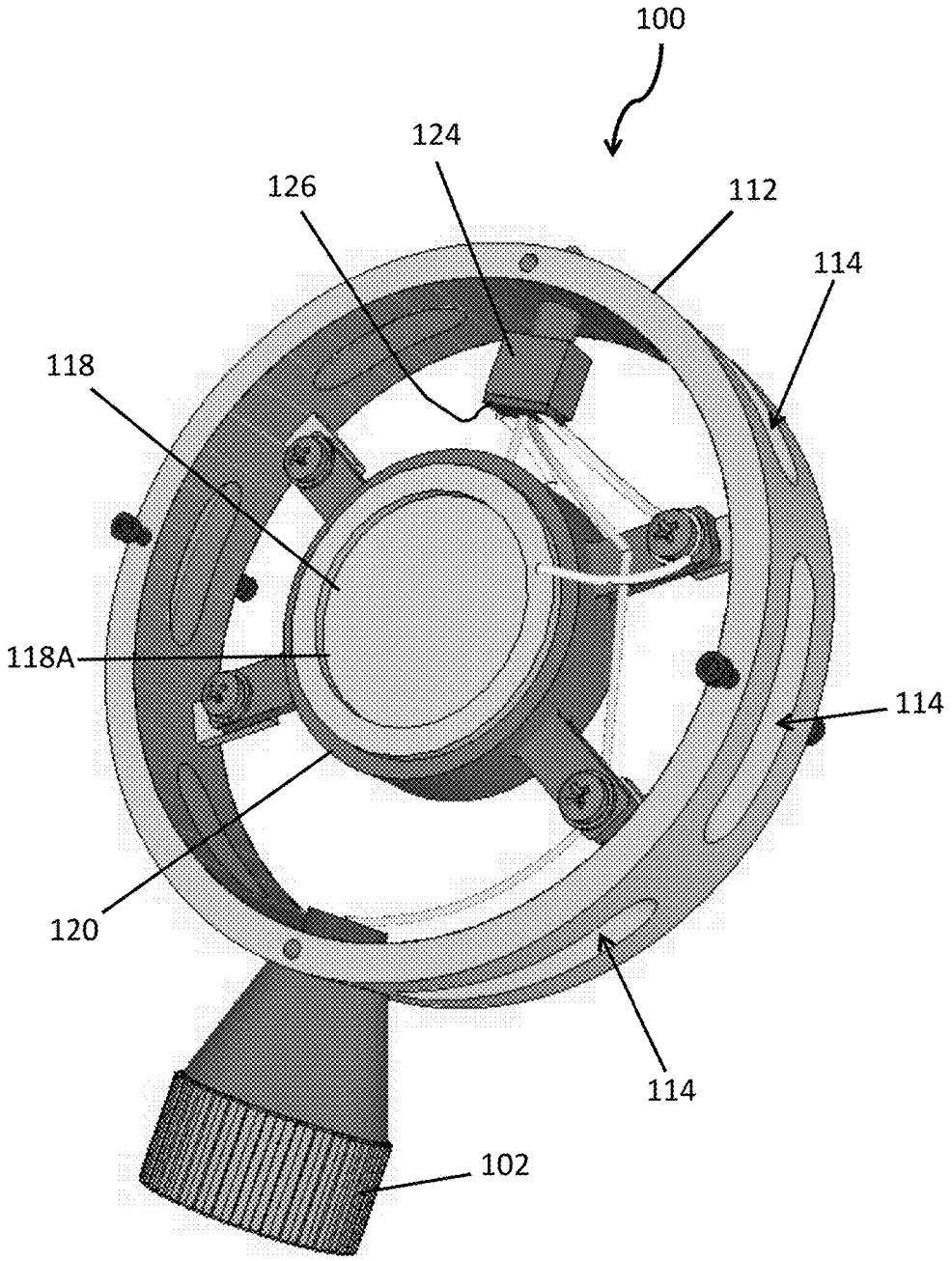
FIG. 3 is a front perspective view of the assembly of FIG. 1 with the front and rear grills removed.
Figure 4:
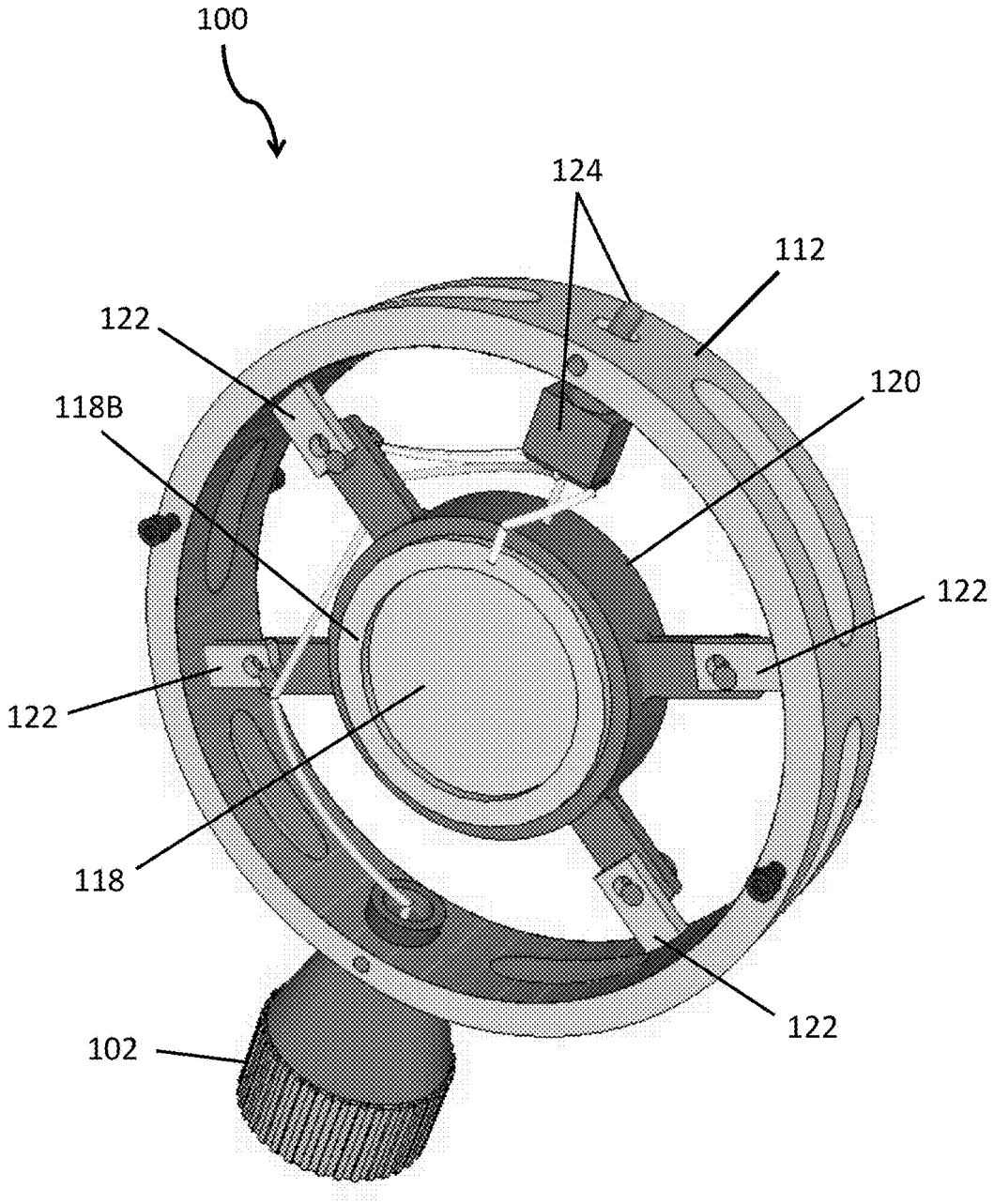
FIG. 4 is rear perspective view of the assembly of FIG. 1 with the front and rear grills removed.
Figure 5:
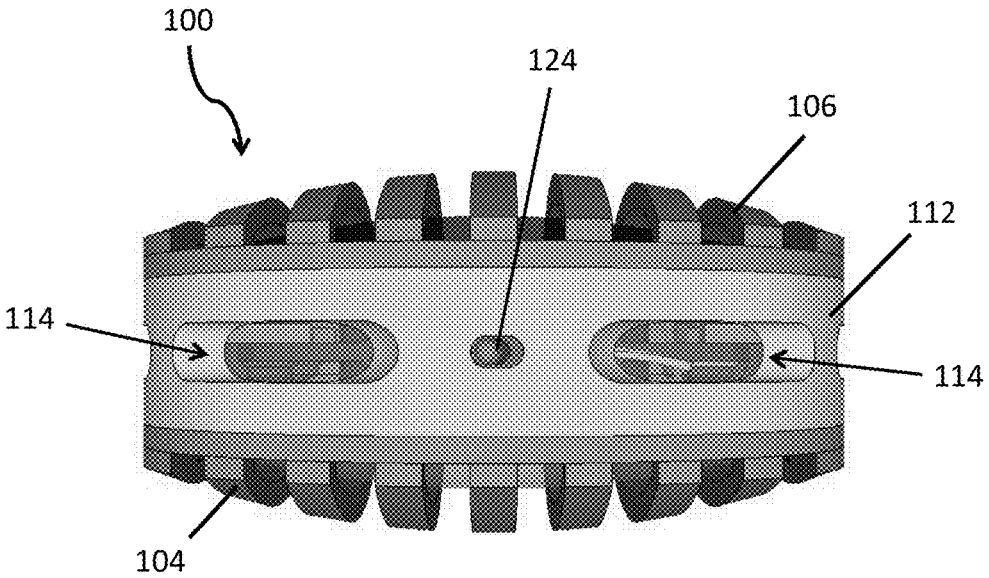
FIG. 5 is a top view of the assembly of FIG. 1.
Figure 6:
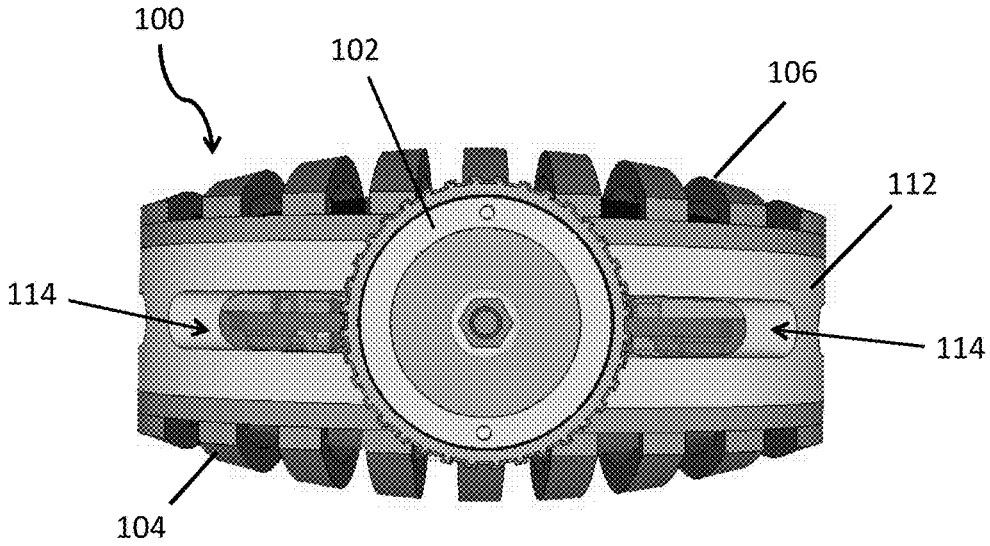
FIG. 6 is a bottom view of the assembly of FIG. 1.
Figure 7A:
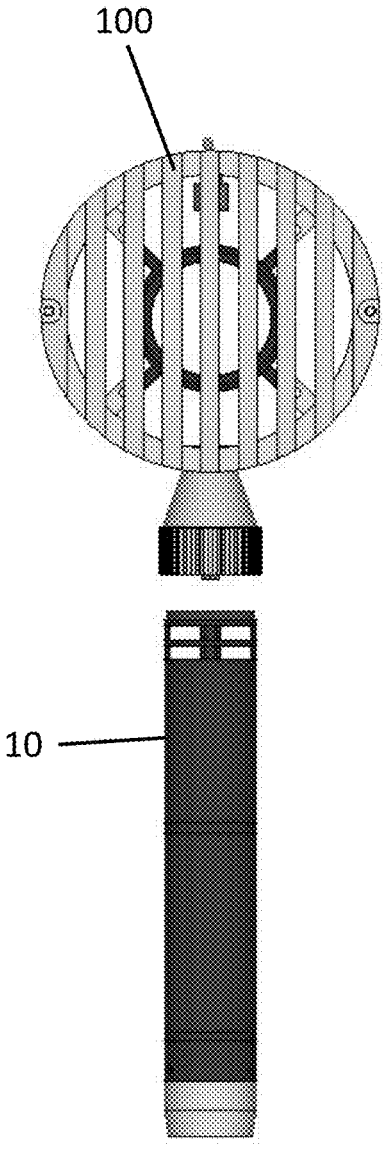
FIG. 7A is a front view of the assembly of FIG. 1 before being secured to a pencil microphone body.
Figure 7B:
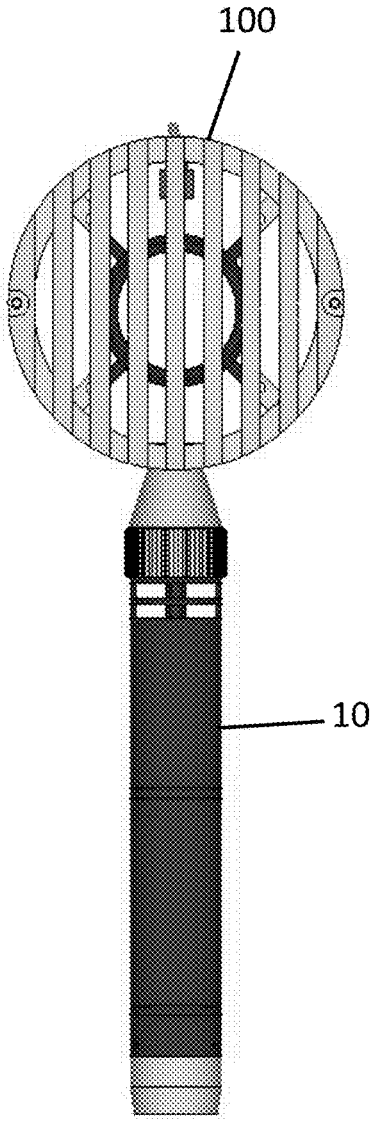
FIG. 7B is a front view of the assembly of FIG. 1 after being secured to a pencil microphone body.

FIGS. 3 and 4 are perspective views of the inside of the assembly 100 with the grills 104, 106 and mesh 108, 110, 116 removed. FIGS. 5 and 6 are top and bottom views, respectively of the assembly 100. A large-diaphragm condenser transducer 118, comprising front and rear diaphragms 118A, 118B and a backplate (not shown), is mounted in a cylindrical harness 120, which is, in turn, secured to radially spaced-apart posts 122 extending inward from the inside surface of the ring 112. Alternatively, the cylindrical harness 120 may be suspended within the ring 112. Wiring couples the transducer 118 and a switch 124 to a printed circuit board (PCB) 126. The PCB 126 may be secured to the bottom of the switch 124. The switch 124 is secured to the ring 112 and may extend through an opening in the ring 112, such as the top, allowing a user to operate the switch 124. Wiring also electrically couples the printed circuit board 126 through the connector 102 to the microphone body 10 (FIGS. 7A, 7B).

The PCB 126 and switch 124 allow the transducer 118 to operate in a number of different polar patterns, such as omni-directional and cardioid. Other patterns or variations may also be achieved. The switch 124, which may be a multi-position switch, a continuously variable potentiometer, or the like. In response to positions of the switch 124, circuitry on the PCB 126 separately controls the phantom power (from the sound console to which the microphone is connected) to the front and rear diaphragms 118A, 118B of the transducer 118. In this way, the electric potential may be varied between the front diaphragm 118A and the backplate and between the rear diaphragm 118B and the backplate, creating the different polar patterns. Preamp circuitry to amplify the audio signal from the transducer 118 is located in the microphone body 10, separate from the pattern switching circuitry on the PCB 126 in the assembly 100. Consequently, in contrast with conventional small diaphragm pencil condenser microphones, the user may select among multiple polar patterns electrically, without having to remove and replace a fixed-pattern transducer or having to physically reposition components within the microphone or capsule assembly.

Figure 8:
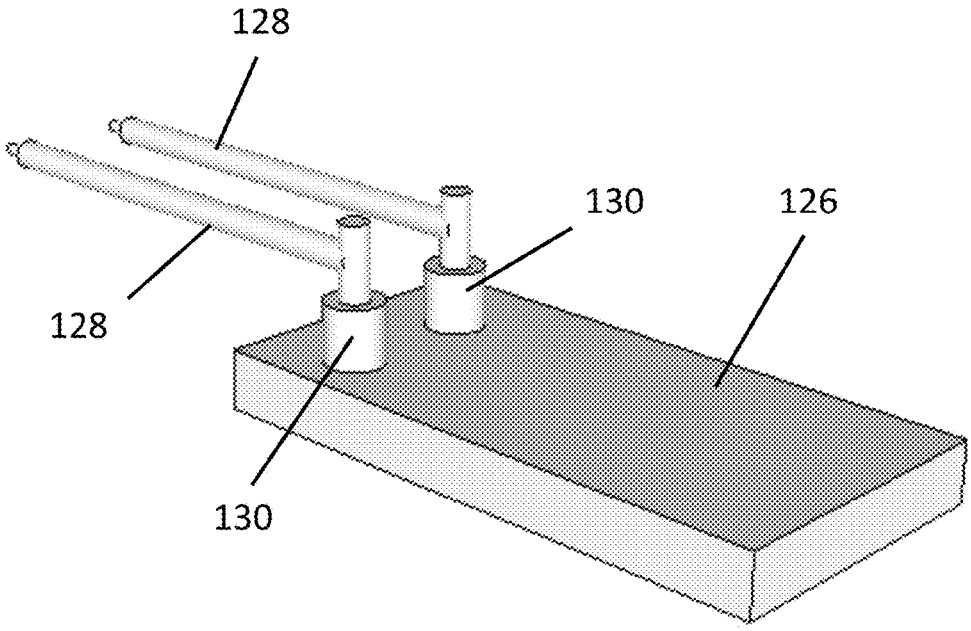
FIG. 8 is a close-up view of high-insulation stand-offs mounted to the printed circuit board and high-insulation wiring electrically coupling the transducer to the printed circuit board.

The challenge in physically separating the preamp circuitry in the microphone body 10 from the switching circuitry on the PCB 126 in the removable assembly 100 is overcoming issues with impedance (essentially, the difficulty or ease of the audio signal moving through the circuit) at the electrical switching section of the circuit. In the electrical switching section of the circuit, impedance is measured in giga-ohms (very high). Electricity will take the easiest path presented, and the path is very difficult throughout the switching circuitry. Even contact with the PCB 126 itself will cause degradation of the audio signal at this stage in the circuit. This means that the audio signal generated by the transducer 118 must be carefully preserved and insulated from any potential alternate path until the audio signal reaches the first stage of the preamp circuitry in the microphone body 10. Illustrated in FIG. 8, the present invention accomplishes this using high-insulation. polytetrafluoroethylene (PTFE), such as Teflon™, wire 128, and PTFE "turrets" or stand-offs 130 to substantially insulate the audio signal on the PCB 126 in order to preserve the integrity of the audio signal. In addition, adding a PCB 126 with the necessary switching circuitry components into a small, confined space such as a capsule assembly with respect to the high impedance, without degrading the signal and without compromising acoustic reflections inside the capsule due to the positioning and size of the electronic components and PCB 126, was very difficult. It required highly specific component selection, including a highly-insulated but micro-sized switch 124, in order to effectively preserve the integrity of the audio signal, both acoustically and electrically.

The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A removable condenser microphone assembly, comprising:

a large-diaphragm condenser transducer having front and rear diaphragms;

a cylindrical harness inside of which the transducer is mounted;

a cylindrical ring inside of which the harness is mounted;

a connector secured to the bottom of the ring configured to removably secure the microphone assembly to a body of a pencil microphone and to removably electrically couple the microphone assembly to pre-amp circuitry within the pencil microphone body;

a switch secured to the ring; and a printed circuit board electrically coupled to the transducer and the switch and, in response to positions of the switch, separately control phantom power to the front and rear diaphragms of the transducer creating a plurality of selectable polar patterns of the transducer.

2. The removable condenser microphone assembly of claim 1, further comprising:

high-insulation wiring electrically coupling the transducer with the printed circuit board; and high-insulation stand-offs mounted to the printed circuit board to receive the high-insulation wiring;

whereby the audio signal from the transducer is substantially insulated.

3. The removable condenser microphone assembly of claim 2, wherein the high-insulation wiring comprises PTFE wire.

4. The removable condenser microphone assembly of claim 2, wherein the high-insulation stand-offs comprise PTFE.

5. The removable condenser microphone assembly of claim 1, wherein the ring has a plurality of radially spaced apart openings formed through the perimeter.

6. The removable condenser microphone assembly of claim 1, wherein the ring has a plurality of radially spaced apart elongated openings formed through the perimeter.

7. The removable condenser microphone assembly of claim 1, wherein the switch extends through the ring.

8. The removable condenser microphone assembly of claim 1, wherein the switch is mounted to the printed circuit board.

9. The removable condenser microphone assembly of claim 1, wherein the switch comprises a multi-position switch.

10. The removable condenser microphone assembly of claim 1, wherein the switch comprises an insulated micro toggle switch.

11. The removable condenser microphone assembly of claim 1, wherein the switch comprises a continuously variable potentiometer.

12. The removable condenser microphone assembly of claim 1, further comprising a plurality of radially spaced-apart posts securing the harness to the inside of the cylindrical ring.

13. The removable condenser microphone assembly of claim 1, wherein the harness is suspended inside the cylindrical ring.

14. A removable condenser microphone assembly, comprising:

a large-diaphragm condenser transducer having front and rear diaphragms mounted inside a cylindrical ring;

a connector secured to the bottom of the ring configured to removably secure the microphone assembly to a microphone body and to removably electrically couple the microphone assembly to pre-amp circuitry within the microphone body;

a switch secured to the ring; and a printed circuit board electrically coupled to the transducer and the switch and, in response to positions of the switch, separately control phantom power to the front and rear diaphragms of the transducer creating a selectable plurality of polar patterns of the transducer.

15. The removable condenser microphone assembly of claim 14, wherein the microphone body comprises a pencil microphone body.

16. The removable condenser microphone assembly of claim 14, further comprising:

high-insulation wiring electrically coupling the transducer with the printed circuit board; and high-insulation stand-offs mounted to the printed circuit board to receive the high-insulation wiring;

whereby the audio signal from the transducer is substantially insulated.

17. The removable condenser microphone assembly of claim 14, wherein:

the high-insulation wiring comprises PTFE wire; and the high-insulation stand-offs comprise PTFE.

18. The removable condenser microphone assembly of claim 14, wherein the ring has a plurality of radially spaced apart openings formed through the perimeter.

19. The removable condenser microphone assembly of claim 14, wherein the switch is mounted to the printed circuit board.

20. The removable condenser microphone assembly of claim 14, further comprising a cylindrical harness inside of which the transducer is mounted, the cylindrical harness being mounted inside the cylindrical ring.

* * * * *